US009383113B1

(12) United States Patent
Renwick

(10) Patent No.: US 9,383,113 B1
(45) Date of Patent: Jul. 5, 2016

(54) DETACHABLE HOOD FOR A CHAIR

(71) Applicant: Catherine Renwick, Shelocta, PA (US)

(72) Inventor: Catherine Renwick, Shelocta, PA (US)

( * ) Notice: Subject to any disclaimer, the term of this patent is extended or adjusted under 35 U.S.C. 154(b) by 0 days.

(21) Appl. No.: 14/810,632

(22) Filed: Jul. 28, 2015

(51) Int. Cl.
*A47C 7/62* (2006.01)
*F24C 15/22* (2006.01)
*A47C 7/66* (2006.01)

(52) U.S. Cl.
CPC . *F24C 15/22* (2013.01); *A47C 7/62* (2013.01); *A47C 7/66* (2013.01)

(58) Field of Classification Search
CPC ..... A47C 7/66; A47C 7/62; F24C 15/22
USPC ..... 297/184.17, 184.1, 184.16, 184.15; 135/125; 403/373; 248/231.51, 229.13, 248/229.23, 228.4, 230.4, 316.5
See application file for complete search history.

(56) References Cited

U.S. PATENT DOCUMENTS 1,196,207 A 8/1916 Cane
3,241,160 A * 3/1966 Cesar Escobar Pablo ..... A47C 7/66 297/184.17
3,845,985 A * 11/1974 Behrend ..... A47C 7/66 297/184.14
4,083,601 A 4/1978 McBeth
5,263,468 A * 11/1993 Powell ..... A61F 7/00 126/204
5,535,973 A * 7/1996 Bailey ..... F16B 45/06 248/214
D378,540 S 3/1997 Becker
5,623,919 A * 4/1997 Kelly ..... A47C 7/66 126/204
6,296,002 B1 10/2001 Tashchyan
6,789,557 B1 * 9/2004 Wahl, Jr. ..... A47C 7/66 135/117
7,226,126 B1 * 6/2007 Spanovich ..... A47C 4/286 135/96
7,311,355 B2 12/2007 Fargason, III
7,427,101 B1 9/2008 Zernov
7,823,968 B2 11/2010 Long et al.
D725,424 S * 3/2015 Cohen ..... D6/716.8
9,215,935 B2 * 12/2015 Surek ..... A47C 7/66
2003/0010371 A1 1/2003 Langley
2010/0108838 A1 * 5/2010 Demartine ..... F16M 11/10 248/222.14
2011/0179548 A1 * 7/2011 Weston ..... A41D 3/02 2/84

* cited by examiner

*Primary Examiner* — Milton Nelson, Jr.
(74) *Attorney, Agent, or Firm* — Kyle A. Fletcher, Esq.

(57) ABSTRACT

The hood for a chair is a camping accessory. The hood for a chair is a lined accessory adapted for use with a camping chair that reflects the heat from a campfire towards the occupant of the camping chair. The hood for a chair comprises a shell, a frame, and at least one clamping member. Moreover, the at least one clamping member is adapted to secure the shell and the frame to the camping chair. The at least one clamping member is affixed to the frame, and is adapted to clamp onto the legs of the camping chair in order to support the shell.

9 Claims, 6 Drawing Sheets

DETACHABLE HOOD FOR A CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of camping equipment and thermal management, more specifically, an accessory configured for use with a camping chair.

SUMMARY OF INVENTION

The hood for a chair is a camping accessory. The hood for a chair is a lined accessory adapted for use with a camping chair that reflects the heat from a campfire towards the occupant of the camping chair. The hood for a chair comprises a shell, a frame, and at least one clamping member. Moreover, the at least one clamping member is adapted to secure the shell and the frame to the camping chair. The at least one clamping member is affixed to the frame, and is adapted to clamp onto the legs of the camping chair in order to support the shell.

These together with additional objects, features and advantages of the hood for a chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the hood for a chair in detail, it is to be understood that the hood for a chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hood for a chair.

It is therefore important that the claims be regarded as including such equivalent construction insofar as they do not depart from the spirit and scope of the hood for a chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
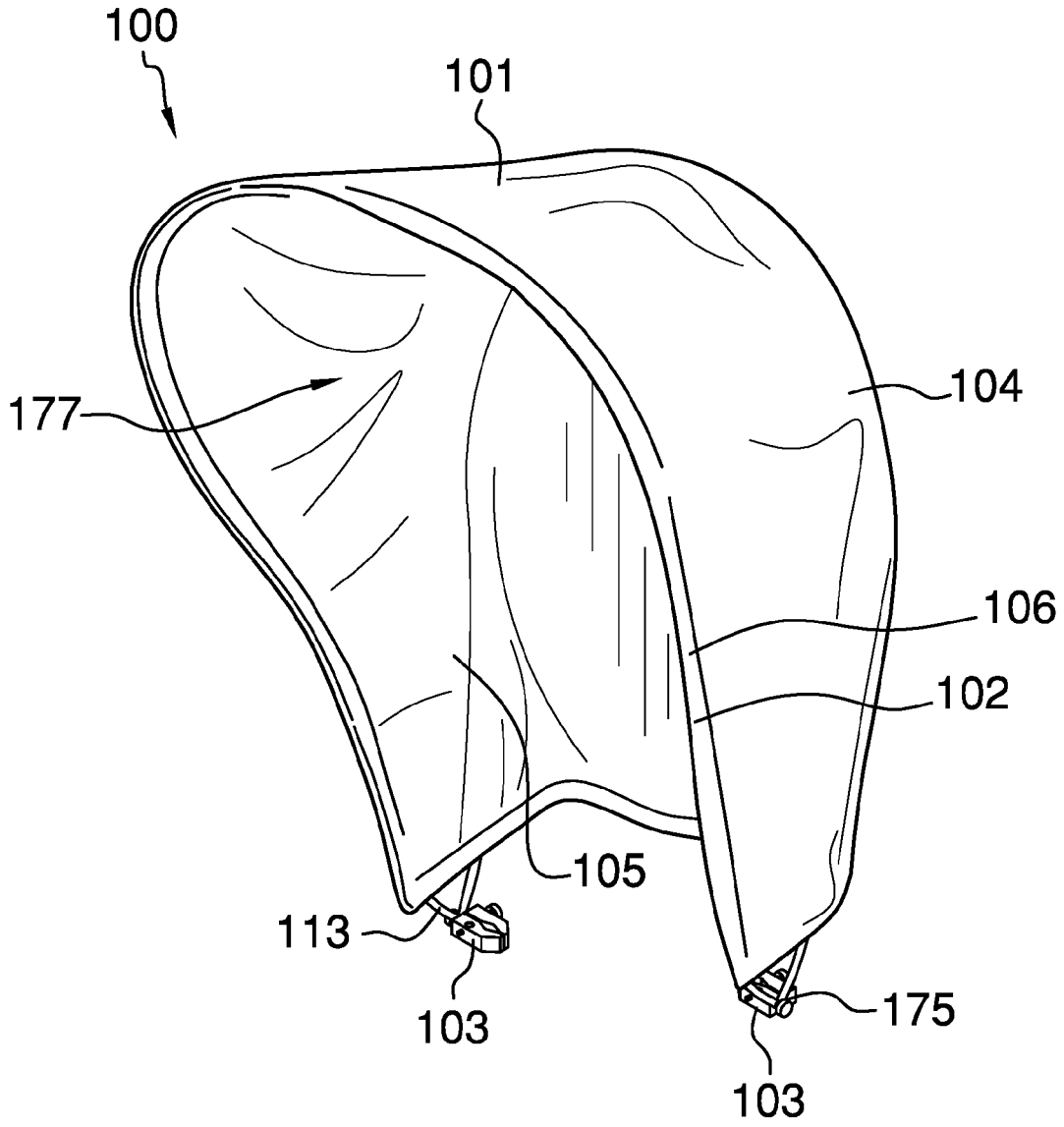
FIG. 1 is a perspective view of an embodiment of the disclosure.
Figure 2:
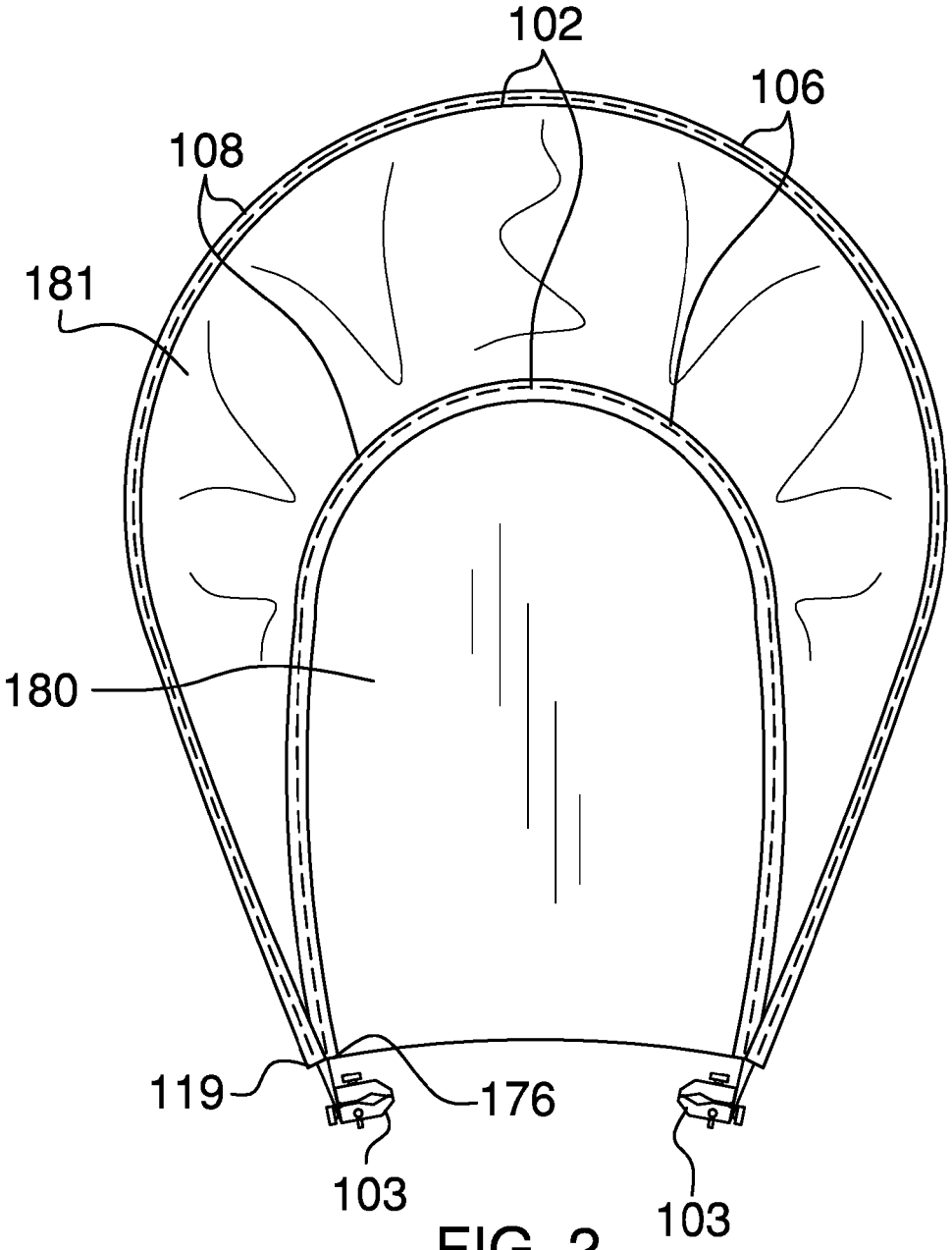
FIG. 2 is a back view of an embodiment of the disclosure.
Figure 3:
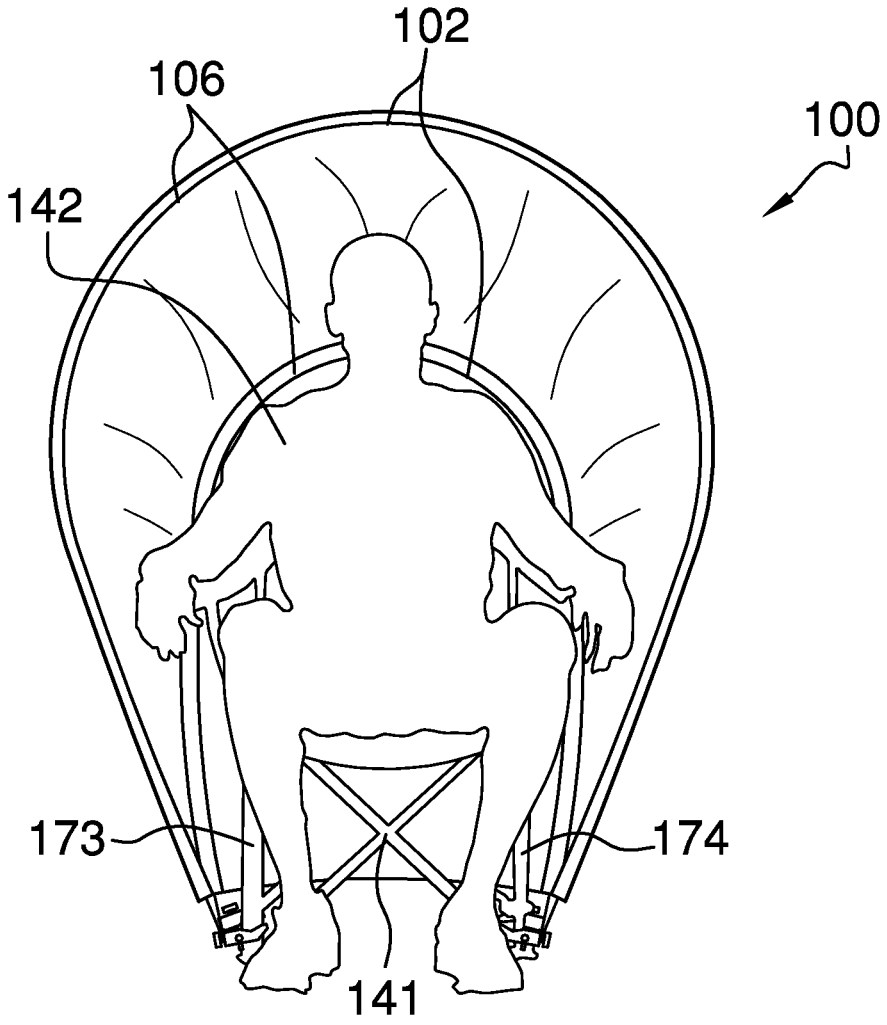
FIG. 3 is a front view of an embodiment of the disclosure in use.
Figure 4:
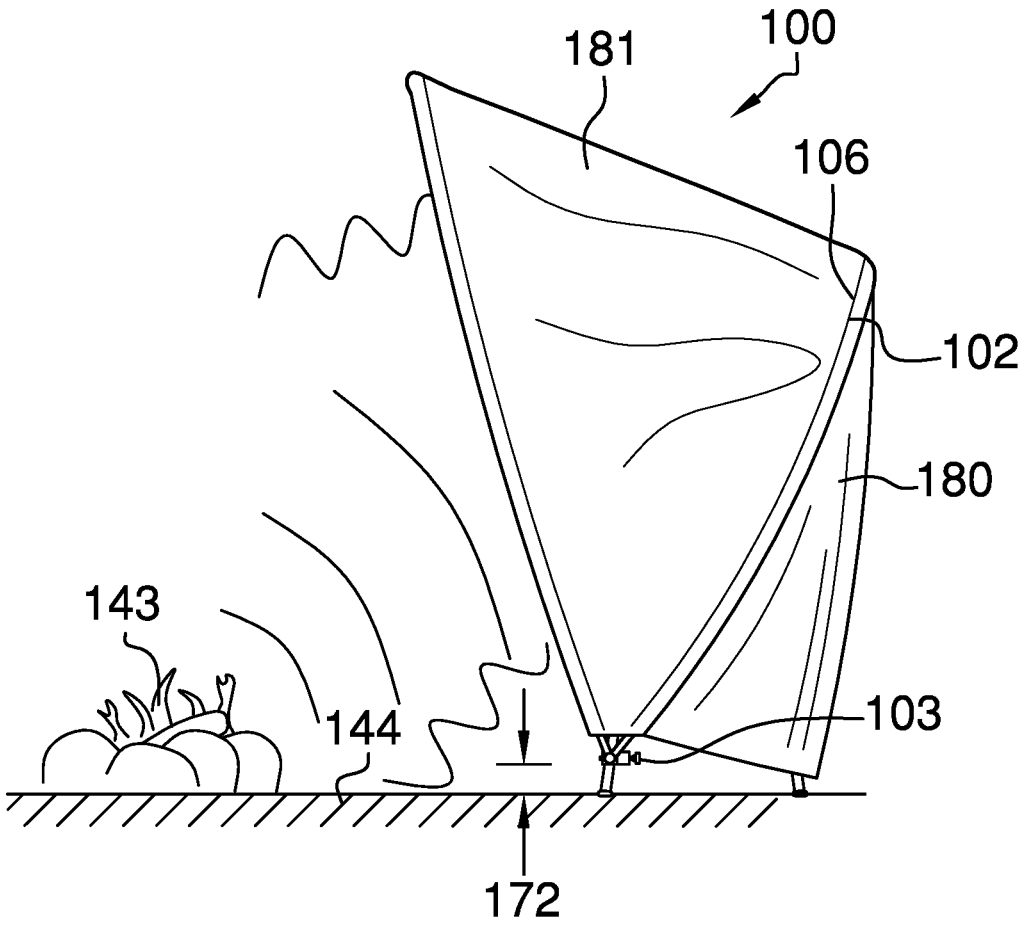
FIG. 4 is a side view of an embodiment of the disclosure in use.
Figure 5:
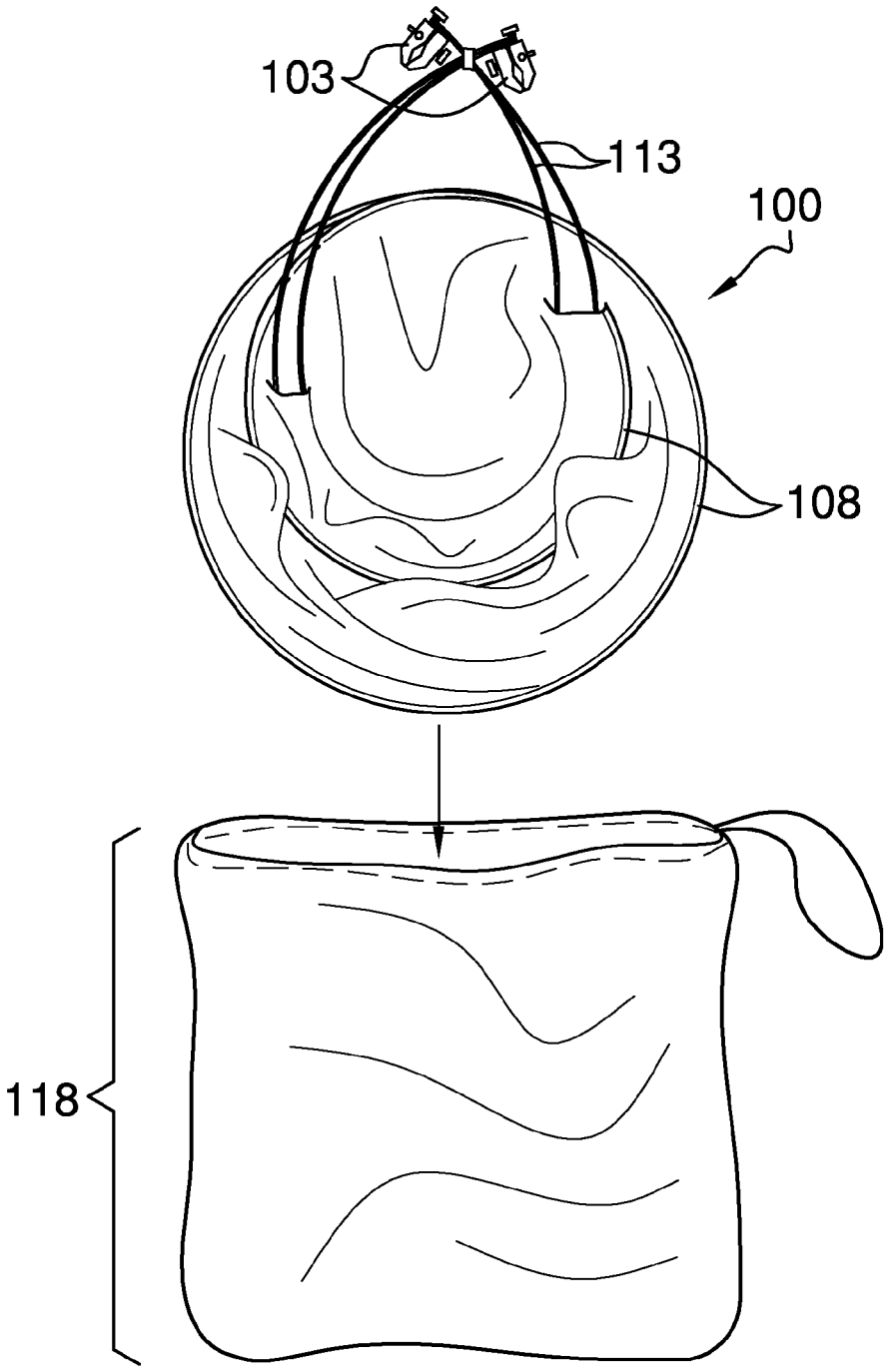
FIG. 5 is a detail view of an embodiment of the disclosure.
Figure 6:
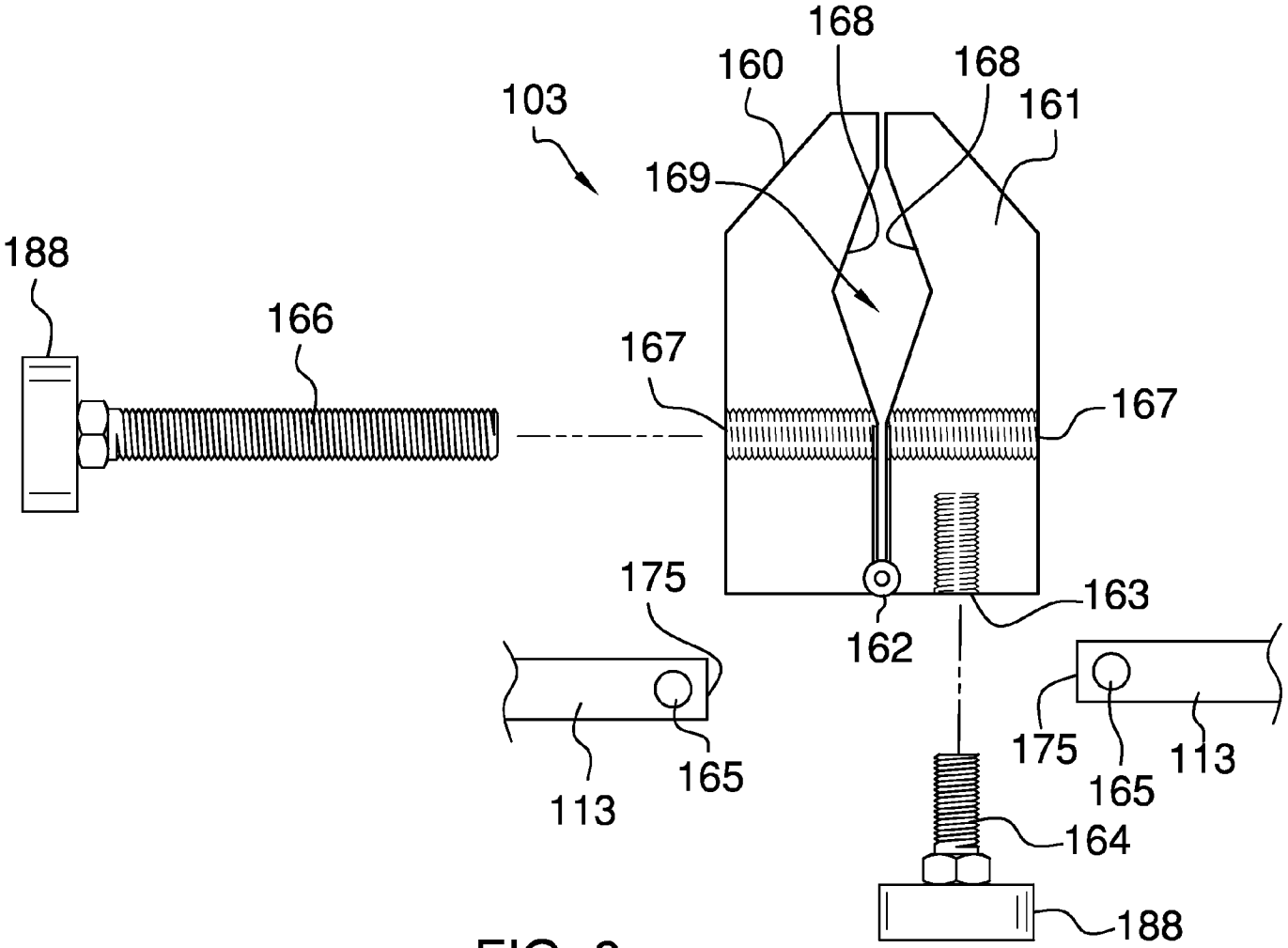
FIG. 6 is a detail view of one of the at least one clamping members.

Detailed reference will now be made to a first potential embodiment of the disclosure, which is illustrated in FIGS. 1 through 6. The hood for a chair 100 (hereinafter invention) is a camping accessory. The invention 100 is an accessory adapted for use with a chair 141 that reflects the heat from a campfire 143 towards the occupant 142 of the chair 141. The invention 100 comprises a shell 101, a frame 102, and at least one clamping member 103.

The purpose of the shell 101 is to create a comfortable environment for both the chair 141 and the occupant 142 by reflecting heat from a campfire 143 into space 177 enclosed by the shell 101. The shell 101 further comprises an exterior 104, a lining 105, one or more frame channels 106. The frame 102 is further defined as a plurality of frame members 108.

The exterior 104 is a waterproof textile or sheeting. The lining 105 is a reflective surface made from textile or sheeting. The reflective surface is a surface that reflects heat received from a campfire 143 back towards the campfire 143. By placing the occupant 142 of a chair 141 between the lining 105 and the campfire 143, this reflected heat warms the occupant 142. The exterior 104 and lining 105 are joined to form two layers of a composite textile, which is called the shell base 118.

One or more frame channels 106 are formed in the shell base 118. Each frame channel from the one or more frame channels 106 is a sleeve that is sized to receive one of the plurality of frame members 108. Each frame channel from the one or more frame channels 106 is further defined with a first opening 119 and a second opening 176. At the first opening 119 and the second opening 176 of each frame channel selected from the one or more frame channels 106, an individual frame member 113 is selected from the plurality of frame members 108, and is attached to the shell base 118.

Each of the plurality of frame members 108 is further defined with a clamping distal end 175, which has one of the at least one clamping members 103 affixed thereto. The at least one clamping members 103 is further defined as a pair of clamping members 103. The pair of clamping members 103 are provided on opposing sides of the shell base 118. Moreover, the pair of clamping members 103 are oriented inwardly so as to face one another (see FIG. 2).

The pair of clamping members 103 are adapted to clamp onto the chair 141. Moreover, the chair 141 is further defined with a first chair leg 174 and a second chair leg 173. The first chair leg 174 and the second chair leg 173 are the legs of the chair 141 closest the campfire 143. The pair of clamping members 103 are adapted to clamp onto the first chair leg 174 and the second chair leg 173 just above a ground 144. Moreover, the pair of clamping members 103 are situated a clamping elevation 172 above the ground 143. The clamping elevation 172 is not greater than 12 inches.

The frame 102 further comprises the plurality of frame members 108. The plurality of frame members 108 are constructed of a spring steel to provide high flexibility. Each of the plurality of frame members 108 is fitted through one of the one or more frame channels 106. The pair of clamping members 103 suspend both the frame 102 and the base shell 118 above and behind the chair 141 as well as the occupant 142.

The exterior 104 and lining 105 can be joined by several methods including, but not limited to, bonding with glue, bonding with resin, or sewing. Commercially available composite textiles can also be used. Methods to form the one or more frame channels 106 are well known and documented in the art. Commercially available tent frame connectors can be used for the plurality of frame members 108.

To use the invention 100, each of the plurality of frame members 108 is inserted into one of the one or more frame channels 106 so that only one individual frame members 113 is inserted in each of the one or more frame channels 106. Once the plurality of frame members 108 are inserted into the one or more frame channels 106. As the plurality of frame members 108 is inserted, the frame 102 take shape and raises the shell 101.

Once the shell 101 is raised, the invention 100 is positioned so that the lining 105 faces the campfire 143. Once the invention 100 is positioned, it is secured in place with the chair 141 via the pair of clamping members 103. The chair 141 can then be placed in front of the campfire 143 for the occupant 142 to use. To take down the invention 100, the above steps are reversed.

The pair of clamping members 103 is further defined with a first armature 160 and a second armature 161 that are pivotable with respect to one another via a hinge 162. The first armature 160 mirrors the shape of the second armature 161. The second armature 161 includes a first threaded hole 163 that enables a first threaded member 164. The first threaded member 164 enables each of the clamping distal ends 175 of the plurality of frame members 108 to the respective one of the pair of clamping members 103. The plurality of frame members 108 each include a clamp hole 165 adjacent the clamping distal end 175. The first threaded member 175 extends through the clamp hole 165 in order to secure the individual frame member 113 to the second armature 161.

The first armature 160 and the second armature 161 are tightened with respect to one another via a second threaded member 166 that screws into a second threaded hole 167 provided on both the first armature 160 and the second armature 161. The second threaded hole 167 of the second armature 161 is perpendicularly-oriented with respect to the first threaded hole 163. The first armature 160 and the second armature 161 each include a recess 168 that forms an opening 169 for either the first chair leg 173 or the second chair leg 174 to be inserted.

It shall be noted that the first threaded member 164 and the second threaded member 166 may include a gripping member 188 to aid in rotating the respective component.

The shell 101 has a shape resembling a bonnet, and which is further characterized with a rear, curved portion 180 and an alcove portion 181. The alcove portion 181 extends over top of the chair 141 and the occupant 142. The shell 101 may be folded up and inserted into a storage case 190 when the invention 100 is not in use (see FIG. 5). Moreover, the plurality of frame members 108 and the pair of clamping members 103 can be folded up and inserted into the storage case 190 when the invention 100 is not in use.

The following definitions are used in this disclosure:

Composite Textile: As used in this disclosure, a composite textile is a multilayer fabric made of two or more joined layers of textile or sheeting materials.

Textile: As used in this disclosure, a textile is a material that is woven, knitted or felted. Synonyms in common usage for this definition of textile include fabric and cloth.

Sheeting: As used in this disclosure, sheeting is a material, such as cloth or plastic, in the form of a thin flexible layer or layers that can be used to cover something.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hood comprising:

a shell, a frame, and at least one clamping member;

wherein the hood is adapted for use with a chair;

wherein the hood is adapted for use with a campfire;

wherein the hood reflects heat from the campfire towards space enclosed via the shell covering both an occupant and the chair;

wherein the shell further comprises an exterior, a lining, one or more frame channels; wherein the exterior and lining are joined to form two layers of a composite textile, which is further defined as a shell base;

wherein the frame is further defined as a plurality of frame members;

wherein the one or more frame channels are formed in the shell base; wherein each frame channel from the one or more frame channels is a sleeve that is sized to receive one of the plurality of frame members; wherein each frame channel from the one or more frame channels is further defined with a first opening and a second opening;

wherein at the first opening and the second opening of each frame channel selected from the one or more frame channels, an individual frame member is selected from the plurality of frame members, and is attached to the shell base;

wherein each of the plurality of frame members is further defined with a clamping distal end, which has the at least one clamping member affixed thereto;

wherein the at least one clamping member is further defined as a pair of clamping members; wherein the pair of clamping members are provided on opposing sides of the shell base; wherein the pair of clamping members are oriented inwardly so as to face one another;

wherein the pair of clamping members are adapted to clamp onto the chair; wherein the pair of clamping members is adapted to clamp onto a first chair leg and a second chair leg of the chair, and which are the legs of the chair closest the campfire;

wherein the pair of clamping members are adapted to clamp onto the first chair leg and the second chair leg just above a ground;

wherein the frame further comprises the plurality of frame members; wherein the plurality of frame members are constructed of a spring steel to provide high flexibility; wherein each of the plurality of frame members is fitted through one of the one or more frame channels; wherein the pair of clamping members adaptively suspend both the frame and the shell base above and behind the chair as well as the occupant;

wherein the pair of clamping members is further defined with a first armature and a second armature that are pivotable with respect to one another via a hinge.

2. The hood according to claim 1 wherein the pair of clamping members is positioned at a clamping elevation above the ground; wherein the clamping elevation is not greater than 12 inches.

3. The hood according to claim 1 wherein the shell has a shape resembling a bonnet, and which is further characterized with a rear, curved portion and an alcove portion.

4. The hood according to claim 3 wherein the alcove portion is adapted to extend over top of the chair and the occupant.

5. The hood according to claim 1 wherein the first armature mirrors the shape of the second armature; wherein the second armature includes a first threaded hole that enables a first threaded member.

6. The hood according to claim 5 wherein the first threaded member enables each of the clamping distal ends of the plurality of frame members to be secured to the respective one of the pair of clamping members; wherein the plurality of frame members each include a clamp hole adjacent the clamping distal end; wherein the first threaded member extends through the clamp hole in order to secure the individual frame member to the second armature.

7. The hood according to claim 6 wherein the first armature and the second armature are tightened with respect to one another via a second threaded member that screws into a second threaded hole provided on both the first armature and the second armature.

8. The hood according to claim 7 wherein the second threaded hole of the second armature is perpendicularly-oriented with respect to the first threaded hole.

9. The hood according to claim 8 wherein the first armature and the second armature each include a recess that forms an opening for either the first chair leg or the second chair leg to be inserted, and secured thereon.

* * * * *